US007264704B2

(12) United States Patent
Nevosi et al.

(10) Patent No.: US 7,264,704 B2
(45) Date of Patent: Sep. 4, 2007

(54) ELECTROLYSIS CELL FOR RESTORING THE CONCENTRATION OF METAL IONS IN ELECTROPLATING PROCESSES

(75) Inventors: Ulderico Nevosi, Milan (IT); Paolo Rossi, Brugherio (IT)

(73) Assignee: De Nora Elettrodi S.p.A., Milan (IT)

( * ) Notice: Subject to any disclaimer, the term of this patent is extended or adjusted under 35 U.S.C. 154(b) by 564 days.

(21) Appl. No.: 10/482,089

(22) PCT Filed: Jun. 28, 2002

(86) PCT No.: PCT/EP02/07182

§ 371 (c)(1),
(2), (4) Date: Dec. 18, 2003

(87) PCT Pub. No.: WO03/002784

PCT Pub. Date: Jan. 9, 2003

(65) Prior Publication Data

US 2004/0182694 A1 Sep. 23, 2004

(30) Foreign Application Priority Data

Jun. 29, 2001 (IT) ..... MI2001A1374

(51) Int. Cl.
*C25D 21/18* (2006.01)
*C25D 21/22* (2006.01)
*C25D 17/00* (2006.01)

(52) U.S. Cl. ..... 205/101; 205/299; 205/300; 205/305; 205/369; 205/291; 205/103; 204/237; 204/275.1

(58) Field of Classification Search ..... 205/101, 205/103, 291, 299–300, 305, 369; 204/237, 204/275.1
See application file for complete search history.

(56) References Cited

U.S. PATENT DOCUMENTS 5,082,538 A * 1/1992 DeRespiris et al. ..... 205/140

FOREIGN PATENT DOCUMENTS

JP 11-172496 * 6/1999

* cited by examiner

*Primary Examiner*—Roy King
*Assistant Examiner*—Lois Zheng
(74) *Attorney, Agent, or Firm*—Charles A. Muserlian

(57) ABSTRACT

It is described an electrolysis cell wherein the anodic dissolution of metals is carried out, in particular of metals characterised by a relatively high oxidation potential, such as copper, or metals with high hydrogen overpotential, for example tin, aimed at restoring both the concentration of said metals, and the pH in galvanic baths used in electroplating processes with insoluble anodes. The cell of the invention comprises an anodic compartment, wherein the metal to be dissolved acts as a consumable anode, and a cathodic compartment, containing a cathode for hydrogen evolution, separated by a cation-exchange membrane. The coupling of the cell of the invention with the electroplating cell allows a strong simplification of the overall process and a sensible reduction in the relevant costs.

8 Claims, 1 Drawing Sheet

Figure 1:
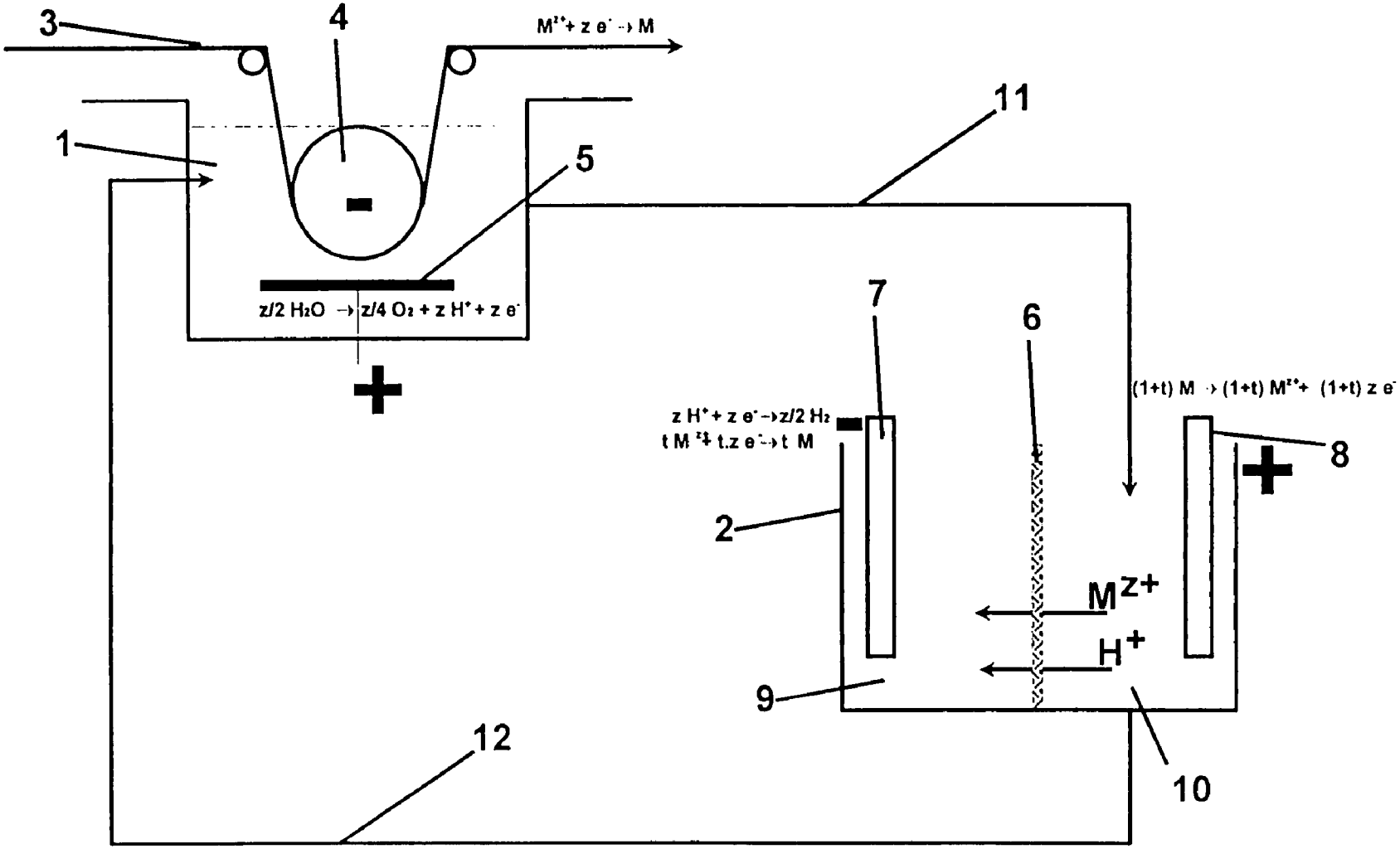

ELECTROLYSIS CELL FOR RESTORING THE CONCENTRATION OF METAL IONS IN ELECTROPLATING PROCESSES

This application is a 371 of PCT/EP02/07182 filed Jun. 28, 2002.

DESCRIPTION OF THE INVENTION

The processes of galvanic electroplating with insoluble anodes are increasingly more widespread for the considerable simplicity of their management with respect to the traditional processes with consumable anodes, also due to the recent improvements obtained in the formulation of dimensionally stable anodes for oxygen evolution both in acidic and in alkaline environments. In the traditional processes of galvanic plating, the conductive surface to be coated is employed as the cathode in an electrolytic process carried out in an undivided cell wherein the concentration of the metal ions to be deposited is kept constant by means of the dissolution of a soluble anode under different forms (plates, shavings, spheroids, and so on).

The positively polarised anode is thus progressively consumed, releasing cations which migrate under the action of the electric field and deposit on the negatively polarised cathodic surface. Although this process is almost always advantageous in terms of energetic consumption, being characterised by a reversible potential difference close to zero, some definitely negative characteristics make it inconvenient especially when continuous deposited layers having very uniform thickness are desired; the most evident of such characteristics is the progressive variation in the interelectrodic gap due to the anode consumption, usually compensated by means of sophisticated mechanisms. Furthermore, the anodic surface consumption invariably presents a non fully homogeneous profile, affecting the distribution of the lines of current and therefore the quality of the deposit at the cathode.

In most of the cases, the anode must be replaced once a consumption of 70-80% is reached; then, a new drawback arises, due to the fact that it is nearly always necessary to shut-down the process to allow for the replacement, especially in the case, very frequent indeed, that the anode be hardly accessible. All of this implies higher maintenance costs and loss of productivity, particularly for the continuous cycle manufacturing systems (such as coating of wires, tapes, rods, bars and so on).

For the above reasons, in most of the cases it would be desirable to resort to an electroplating cell wherein the metal to be deposited is entirely supplied in ionic form into the electrolyte, and wherein the anode is of the insoluble type, with a geometry which can be optimised, so as to fix the preferred interelectrodic gap to guarantee a quality and homogeneity of the deposit appropriate for the most critical applications, suitable for continuous operations For this purpose, as the vast majority of the galvanic applications is carried out in an aqueous solution, the use of an electrode suitable to withstand, as the anodic half-reaction, the evolution of oxygen, is convenient. The most commonly employed anodes are constituted of valve metals coated with an electrocatalytic layer (for instance noble metal oxide coated titanium), as is the case of the DSA® anodes commercialised by De Nora Elettrodi S.p.A, Italy.

To maintain a constant concentration of the ion to be deposited in the electrolytic bath, it is necessary however to continuously supply a solution of the same to the electroplating cell, accurately monitoring its concentration. Obtaining the metal in a solution may be a problem in some cases, in particular, for the majority of the galvanic applications, the added value of the production is too low to allow the use of oxides or carbonates of adequate purity, and cost considerations demand to directly dissolve the metal to be deposited in an acidic solution.

The direct chemical dissolution of a metal is not always a feasible or easy operation: in some cases of industrial relevance, for instance in the case of copper, simple thermodynamic considerations indicate that a direct dissolution in acid with evolution of hydrogen is not possible, as the reversible potential of the couple Cu(0)/Cu(II) is more noble (+0.153 V) than the one of the couple $H_2/H^+$; for this reason, the baths for copper plating are often prepared by dissolution of copper oxide, that nevertheless has a cost which is prohibitive for the majority of the applications of industrial relevance.

In other cases it is instead a kinetic type obstacle which makes the direct chemical dissolution problematic; in the case of zinc, for example, even if the reversible potential of the couple Zn(0)/Zn(II) (−0.76 V) is significantly more negative than the one of the couple $H_2/H^+$, the kinetic penalty of the hydrogen evolution reaction on the surface of the relevant metal (hydrogen overpotential) is high enough to inhibit its dissolution, or in any case to make it proceeding at unacceptable velocity for applications of industrial relevance. A similar consideration holds true also for tin and lead. This kind of problem may be avoided by acting externally on the electric potential of the metal to be dissolved, namely carrying out the dissolution in a separate electrolytic cell (dissolution or enrichment cell) wherein said metal is anodically polarised so that it may be released in the solution in ionic form, with concurrent evolution of hydrogen at the cathode. The compartment of such cell must be evidently divided by a suitable separator, to avoid that the cations released by the metal migrate towards the cathode depositing again on its surface under the effect of the electric field. The prior art discloses two different embodiments based on said concept; the first one is described in the European Patent 0 508 212, relating to a process of copper plating of a steel wire in alkaline environment with insoluble anode, wherein the electrolyte, based on potassium pyrophosphate forming an anionic complex with copper, is recirculated through the anodic compartment of an enrichment cell, separated from the relative cathodic compartment by means of a cation-exchange membrane. Such device provides for continuously restoring the concentration of copper in the electrolytic bath, but the cupric anionic complex formed in the reaction alkaline environment involves some drawbacks. In particular, the copper released into the solution in the enrichment cell is mostly but not totally engaged in the pyrophosphate complex. The fraction of copper present in cationic form, even if small, binds to the functional groups of the membrane itself making its ionic conductivity decrease dramatically. A further fraction tends then to precipitate inside the membrane itself in the form of hydrate oxide crystals, extremely dangerous for the structural integrity of the membrane itself.

Finally, in EP 0 508 212 an unwelcome process complication is made evident, as the electroplating cell tends to be depleted of hydrogen ions (consumed at the anodic compartment), which must be re-established through the addition of potassium hydroxide formed in the catholyte of the enrichment cell. Such re-establishment of the alkalinity requires a continuous monitoring, implying an increase in the costs both of the system and its management.

In those cases where the matrix to be coated inside the electroplating cell makes it possible, it may be convenient carrying out the process in an acidic environment rather than in an alkaline environment. In this way, the metal involved in the process is in any case entirely present in the cationic form but the possibilities that it may either bind to the functional groups of the membrane in the dissolution cell or precipitate inside the same, are drastically reduced. The use of an acidic bath, as an alternative to the alkaline bath, is foreseen in a second embodiment of the prior art, described in the international patent application WO 01/92604 whose content is incorporated herein as a reference. In said embodiment, the separator used in the dissolution cell is an anion-exchange membrane, and in principle there is no limitation to the use of acidic or alkaline baths, as disclosed in the description. The process of WO 01/92604 has the advantage of being completely self-regulating; however, the industrial applications carried out so far according to the teachings of WO 01/92604 relate to the use in alkaline environment, even if in principle the process could be likewise applied to an acidic bath. In fact, although the recent developments in the field of anion-exchange membranes may prospect future improvements in this direction, today said membrane exhibit an unsatisfactory selectivity in acidic environments as concerns anion migration, which ideally should be nil, with respect to cation migration. This situation constitutes quite an undesirable limitation, as the use of acidic baths is sometimes necessary; in the first place, in some cases the alkaline baths are extremely toxic both for man and the environment (as in the case of cyanide baths, which constitute the most common types of alkaline baths for many metals), in the second place, the acidic baths are less subject to metal precipitation inside the membranes and permit to operate at higher current densities with respect to alkaline baths, wherein as already said, the metal species, being present as an anionic complex, is subject to severe limitations of diffusive type. Further, in many cases, it is convenient inserting the dissolution cells in existing galvanic plants, where previously dissolution methods, obsolete or less convenient, were utilised, such as for examples, the dissolution in the acidic bath of oxides or carbonates of the metal. In these cases, usually it is not permitted to change the type of bath, especially due to considerations of corrosion stability of the pre-existing materials; therefore, in those cases where acidic baths were used, it may be impossible integrating a dissolution cell suitable for operating in an alkaline environment.

It is therefore necessary to identify an enrichment cell configuration suitable for coupling with metal electroplating cells capable of operating with acidic baths and of overcoming the drawbacks of the prior art. It is further necessary to detect a process for the operation of a dissolution cell coupled to a metal electroplating cell capable of operating in acidic baths in a substantially self-regulated way.

The present invention is aimed at providing an integrated system of galvanic electroplating cell of the insoluble anode type hydraulically connected with a dissolution or enrichment cell, overcoming the drawbacks of the prior art, in particular exploiting the non complete selectivity for the metallic cation/hydrogen ion transport, typical of cation-exchange membranes. In particular, the present invention is directed to an integrated system of galvanic electroplating cell of the insoluble anode type hydraulically connected to an enrichment cell, which may be operated with acidic electrolytes, characterised in that the balance of all the chemical species is self-regulating, and that no auxiliary supply of material is required except the possible addition of water.

The invention consists in an insoluble anode electroplating cell integrated with a two-compartment enrichment cell fed with an acidic electrolyte divided by at least one separator consisting of a cation-exchange membrane. In a preferred embodiment, the two compartments of the enrichment cell may act alternately as anodic or cathodic compartments. In the electroplating cell, the metal is deposited from the corresponding cation onto a cathodically polarized matrix and at the same time oxygen is evolved at the anode which act as a counter-electrode, and consequently acidity is developed.

The dissolution or enrichment cell provides in a self-regulating way, for restoring the deposited metal concentration and at the same time neutralises the acidity formed in the electroplating cell. Said self-regulation is permitted by the fact that, under given electrochemical and fluid dynamic operating conditions the ratio between metal ions and hydrogen ions migrating through the cation exchange membrane in the enrichment cell is also constant. In particular, the metal whose concentration is to be restored is dissolved in the anodic compartment of the enrichment cell and recirculated to the electroplating cell; a fraction of the metal (typically in the range of 2-15% of the total current, depending, as aforesaid, on the process conditions and nature of the cation) migrates under the electric field effect through the cation-exchange membrane, without however precipitating inside the same or blocking the functional groups of the membrane itself due to the acidic environment. The metal fraction migrating through the ion-exchange membrane deposits onto the cathode of the enrichment cell, from where it will be recovered in the subsequent current potential reversal cycle of the two compartments. The remaining current fraction (85-98% of the total current) is directed to the transport of hydrogen ions from the anodic compartment to the cathodic compartment of the enrichment cell. The hydrogen ions discharge at the cathode, where hydrogen is evolved; accordingly, as the anolyte of the enrichment cell is electrolyte of the electroplating cell, in the enrichment cell also the consumption of the excess acidity produced in the electroplating cell takes place. To achieve a stationary self-regulating condition it is only necessary to apply an excess current density to the enrichment cell with respect to the electroplating current, so that the metal dissolved at the anode is equivalent to the sum of the metal deposited in the electroplating cell and the metal migrating through the membrane and re-deposited at the cathode of the enrichment cell.

The invention will be more readily understood making reference to the figure, which shows the general layout of the process for the deposition and the enrichment of a generic metal M present in the acidic bath in the form of a cation with a charge z+.

Making reference to FIG. 1, (1) indicates the continuous electroplating cell with insoluble anode, (2) indicates the enrichment cell hydraulically connected to the same. The described electroplating treatment refers to a conductive matrix (3) suitable for undergoing the plating process for the metal deposition under continuous cycle, for example a strip or a wire; however, as it will be soon evident from the description, the same considerations apply to pieces subjected to discontinuous-type operation. The matrix (3) is in electrical contact with a cylinder (4) or equivalent electrically conductive and negatively polarised structure. The counter-electrode is an insoluble anode (5), positively polarised. The anode (5) may be made, for example, of a titanium substrate coated by a platinum group metal oxide, or more generally by a conductive substrate non corrodible by the electrolytic bath under the process conditions, coated by a material electrocatalytic towards the oxygen evolution half-reaction. The enrichment cell (2), having the function of supplying the metal ions consumed in the electroplating cell (1), is divided by a cation-exchange membrane (6) into a cathodic compartment (9) provided with a cathode (7) and an anodic compartment (10), provided with a soluble anode (8) made of the metal which has to be deposited on the matrix to be coated (3). The anode (8) may be a planar sheet or another continuous element, or an assembly of shavings, spheroids or other small pieces, in electric contact with a positively polarised permeable conductive confining wall, for instance a web of non corrodible material. In a preferred embodiment of the invention, the anodic and cathodic compartments may be periodically reversed acting on the polarity of the electrodes and on the hydraulic connections; therefore the electrodic geometry must be such as to permit the current reversal.

The anodic compartment (10) is fed with the solution to be enriched coming from the electroplating cell (1) through the inlet duct (11); the enriched solution is in turn recirculated from the anodic compartment (10) of the enrichment cell (2) to the electroplating cell (1) through the outlet duct (12). In the case of an electroplating in acidic environment of metal M from the cation $M^{z+}$, the process occurs according to the following scheme:

conductive matrix (3) $M^{z+}+z\ e^- \rightarrow M$ insoluble anode (5) $z/2\ H_2O \rightarrow z/4\ O_2+z\ H^++z\ e^-$ The solution depleted of metal ions $M^{z+}$and enriched in acidity (for the anodic production of z $H^+$), as afore said, is circulated through the duct (11) in the anodic compartment (10) of the enrichment cell (2), wherein a soluble anode (8) made of positively polarised M metal, is oxidised according to:

$$(1+t)M \rightarrow (1+t)M^{z+}+(1+t)z\ e^-$$

and the excess acidity is neutralised through the transport, shown in FIG. 1, of hydrogen ions from the anodic compartment (10) to the cathodic compartment (9), of the enrichment cell (2).

Such migration of hydrogen ions is made possible by the fact that the separator (6) selected to divide the compartments (9) and (10) is a cationic membrane; the driving force supporting the same is the electric field, to which the contributions of osmotic pressure and diffusion add up.

The hydrogen ions migrating through the membrane (6) restore the pH of the bath circulating-between the anodic compartment (10) of the enrichment cell (2) and the electroplating cell (1), without however affecting that of the cathodic compartment (9) of the enrichment cell (2), where they are discharged at the hydrogen evolving cathode. Not all of the electric current flowing in the enrichment cell (2) is directed to the transport of hydrogen ions; as shown in the FIGURE, a minor fraction of the same is necessarily dissipated in the transport of the metal ion M with a charge z+through the membrane (6). The ratio between the portion of the effective current used for the hydrogen ion transport and the total current is defined as the hydrogen ion transport number and it depends on the equilibrium, which is a function of the concentrations of the two competing ions, on the nature of the metal cation, on the current density and on other electrochemical and fluid dynamic parameters, which are usually fixed. A hydrogen ion transport number comprised between 0.85 and 0.98 is typical of the main electroplating process in acidic baths, for example copper and tin electroplating. The metal cation transported through the membrane (6) of the enrichment cell (2) deposits onto the cathode (7). Therefore the transport of metal M is a parasitic process, which causes the decrease of the overall current efficiency of the enrichment cell (2), defined by the ratio 1/(1+t), and in principle also a loss of the metal to be deposited. This last inconvenience however may be overcome by periodic current reversals whereby the metal deposited at the cathode (7) is re-dissolved by operating the latter as an anode. It is therefore convenient making an accurate choice of the construction material for the cathode (7), which must be fit for operating as an anode, even if for short periods, without corroding. Therefore, rather than nickel and alloys thereof, which are traditional materials for cathodes in electrolytic cells, valve metals (preferably titanium and zirconium) and stainless steel, will be adopted (for example AISI 316 and AISl 316 L), optionally coated by a suitable conductive film according to the prior art teachings.

In order to make the cathodic (9) and anodic (10) compartments of the enrichment cell (2) temporarily interchangeable, it is convenient to act also on the hydraulic connections between the two cells (1) and (2). In particular, when the polarity of the enrichment cell (2) is reversed, the ducts (11) and (12) must be switched to the original cathodic compartment (9), which upon current reversal becomes the anodic compartment. In other words, the electroplating cell (1) must preferably always be in hydraulic connection with the enrichment cell compartment (2) which is time by time anodically polarised, in order to guarantee the self-regulation of the concentrations of all the species.

In stationary conditions, a simple regulation of the excess current of the enrichment cell (2), requires the passage of a hydrogen ion mole through the cation-exchange membrane (6) for each mole of $H^+$ions generated at the anode (5), in order to perfectly balance the acidity of the system and automatically restore the $M^{z+}$ions concentration. In particular, for z moles of electrons transported in the electroplating cell (1), it is simply necessary to apply a current sufficient to provide for the passage of (1+t) ·z moles of electrons to the enrichment cell (2), where the ratio between 1 and (1+t) is the hydrogen ion transport number (equivalent to the faradic efficiency), and the ratio between t and (1+t) is the transport number of the metal cation (parasitic current fraction). In stationary conditions, therefore, with the passage of z moles of electrons in the electroplating cell (1) one mole of metal M is deposited onto the matrix (3) and z moles of $H^+$are released at the insoluble anode (5): concurrently, in the enrichment cell (2) the passage of (1+t)·z moles of electrons takes place with the release of (1+t) moles of $M^{z+}$in the anodic compartment (10), the deposition of t moles of M and the consumption of z moles of $H^+$to form z/2 moles of hydrogen at the cathode (7) of the enrichment cell (2). Thus the cathodic compartment of the enrichment cell (2), is deputed to the hydrogen discharge reaction on the surface of the cathode (7), according to $$zH^++ze^- \rightarrow z/2H_2$$

and to the metal deposition according to $$tM^{z+}+t{\cdot}z\ e^- \rightarrow tM$$

An immediate check of the balance of matter and of charge in this compartment shows how, by means of said half-reaction, for each mole M of metal deposited on the cell (1) the consumption of z moles of hydrogen ions transported through the cation-exchange membrane (6) is exactly effected.

Therefore, the above described process is self-regulating and its overall balance of matter implies only a consumption of water corresponding to the quantity of oxygen released in the electroplating cell and the quantity of hydrogen released in the enrichment cell: the water concentration may be easily restored by a simple filling-up, for example in the electroplating cell (1). In any case, this water filling-up does not imply any further complication of the process, as it is normal, in any electroplating process with consumable anode or insoluble anode, evaporation phenomena lead per se to the need for controlling the water concentration by continuous filling-up. As the cation transport through the membrane (6) of the enrichment cell (2) usually takes place in the hydrated form, it is also possible that a slight concentration of the catholyte in the compartment (9) may be required when the evaporation in this compartment is not sufficient to balance said excess transported water.

The disclosed general scheme can be further implemented with other expedients known to the experts of the field, for instance by delivering the oxygen, which evolves at the anode (5) of the electroplating cell (1), to the cathodic compartment (9) of the enrichment cell (2), to eliminate the hydrogen discharge in the latter and depolarise the overall process with back production of water; in this way a remarkable energy saving is obtained as the electric current consumption imposed by the process is only the amount necessary for the metal M deposition, whereas no overall consumption of water occurs.

The following examples intend to illustrate some industrial embodiments of the present invention without however limiting the same thereto.

EXAMPLE 1

In this experiment, a steel sheet has been subjected to a tin plating process in an electroplating cell containing a bath of methansulphonic acid (200 g/l), bivalent tin (40 g/l) and organic additives according to the prior art, employing as anode a positively polarised titanium sheet, coated with iridium and tantalum oxides, directed to the oxygen evolution half-reaction. An enrichment cell has been equipped with a titanium cathode in the form of a flattened expanded sheet provided with a conductive coating and a consumable anode of tin beads, confined by means of a positively polarised titanium expanded mesh basket provided with an electrically conductive film. The exhaust electrolytic bath, recycled from the electroplating cell has been used as anolyte and a methansulphonic acid solution at low concentration of stannous ions, as the catholyte. The catholyte and the anolyte of the enrichment cell have been divided by means of Nafion® 324 cation-exchange sulphonic membrane, produced by DuPont de Nemours, U.S.A.

Utilising a current density of 2.94 kA/m$^2$ in the enrichment cell, a continuous tin plating of the steel sheet could be carried out for an overall duration of one week, with a faradic efficiency of 94%, without any intervention besides the progressive water filling-up in the electrolyte of the electroplating cell, monitored through a level control, and the forced evaporation in an auxiliary unit of a small fraction of the catholyte, which received excess water due to the hydrogen ions transport migrating through the cation exchange membrane with their hydration shell.

After one week, a current reversal was effected on the enrichment cell for 6 hours in order to dissolve the tin deposited at the cathode, reverting then to normal operation for another week, upon restoring the tin load in the anodic basket.

EXAMPLE 2

A steel wire was subjected to a copper plating process in an electroplating cell containing a bath of sulphuric acid (120 g/l), cupric sulphate (50 g/l) and organic additives according to the prior art, using as the anode a positively polarised titanium sheet, coated with iridium and tantalum oxides, deputed to the oxygen evolution half-reaction.

An enrichment cell, fed at the anodic compartment with the exhaust electrolytic bath coming from the electroplating cell, has been equipped with an AISI 316 stainless steel cathode and a consumable anode of copper shavings, confined by means of a positively polarised titanium mesh basket provided with a conductive coating and enclosed in a highly porous filtering cloth. As the catholyte a sulphuric solution with a low concentration of copper ions has been used. The catholyte and the anolyte of the enrichment cell have been divided by means of a sulphonic cation exchange membrane, Nafion® 324 produced by DuPont de Nemours, U.S.A. Utilising a current density of 4.55 kA/m$^2$ in the enrichment cell, a continuous copper plating of the steel wire could be carried out for an overall durabon of one week with a faradic efficiency of 88%, without any intervention besides the progressive water filling-up in the electroplating cell, monitored through a level control. After one week, a current reversal was effected on the enrichment cell for 6 hours in order to dissolve the copper deposited at the cathode, reverting then to normal operation for another week, upon restoring the copper load in the anodic basket.

In the description and claims of the present application, the word "comprise" and its variation such as "comprising" and "comprises" are not intended to exclude the presence of other elements or additional components.

The invention claimed is:

1. A self-regulating process for restoring the concentration of a metal and the acidity of an acid electrolytic bath coming from at least one electroplating cell where said metal is plated on a conductive negatively polarized matrix while oxygen and acidity are generated at a positively polarized insoluble anode, carried out in at least one enrichment cell comprising an anodic compartment and a cathodic compartment separated by a cation exchange membrane, the anodic compartment comprising a soluble anode made of the metal to be plated and the cathodic compartment comprising a cathode made of a corrosion resistant material, the at least one electroplating cell and the at least one enrichment cell being hydraulically connected, the acid electrolytic bath containing the metal to be plated being recirculated from the anodic compartment of the at least one enrichment cell to the at least one electroplating cell, the at least one electroplating cell and the at least one enrichment cell being respectively supplied with an electroplating current and an enrichment current, wherein the ratio between the enrichment current and the electroplating current is the reciprocal of the current efficiency of the enrichment cell expressed as the hydrogen transport number, and wherein only the water consumed by electrolysis or evaporation is restored, the balance of matter of the remaining species being self-regulated.

2. The process of claim 1 wherein said metal to be plated has an oxidation potential more positive than that of hydrogen.

3. The process of claim 2 wherein said metal is copper.

4. The process of claim 1 wherein said metal to be plated has a high hydrogen overpotential.

5. The process of claim 4 wherein said high hydrogen overpotential metal is selected from the group consisting of zinc, tin and lead.

6. The process of claim 1 wherein the polarity of the anodic compartment and of the cathodic compartment of the enrichment cell is periodically reversed.

7. The process of claim 1 wherein the ratio between said hydrogen transport number and the transport number of the cations of said metal to be plated is comprised between 85:15 and 98:2.

8. The process of claim 1 wherein the oxygen formed at the positively polarized insoluble anode of at least one electroplating cell is bubbled into the cathodic compartment of the at least one enrichment cell.

* * * * *